US006447333B1

(12) United States Patent
Springer

(10) Patent No.: US 6,447,333 B1
(45) Date of Patent: Sep. 10, 2002

(54) COAXIAL CABLE CONVERTER

(75) Inventor: Denis D. Springer, Austin, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/782,668

(22) Filed: Feb. 13, 2001

(51) Int. Cl.[7] ..... H01R 9/05
(52) U.S. Cl. ..... 439/578
(58) Field of Search ..... 439/578, 584, 439/583, 585, 638

(56) References Cited

U.S. PATENT DOCUMENTS 3,678,446 A 7/1972 Siebelist ..... 439/583
6,217,380 B1 * 4/2001 Nelson et al. ..... 439/578

FOREIGN PATENT DOCUMENTS

EP 0 573 078 A1 12/1993

* cited by examiner

*Primary Examiner*—Brian Sircus
*Assistant Examiner*—Javaid Nasri
(74) *Attorney, Agent, or Firm*—Yen Tong Florczak

(57) ABSTRACT

A converter for terminating a coaxial connector to a coaxial cable when the cable shield layer outer diameter is larger than an interior dimension of the connector shell. The converter includes a conductive shell having a first end and a second end. The first end of the converter shell has an inner diameter larger than the outer diameter of the cable conductive shield layer, and the second end of the converter shell has an outer diameter smaller than the interior dimension of the connector shell. A dielectric insulation insert is positioned with the converter shell. The converter may be designed to match the impedance of either the coaxial cable or the connector, or the converter may smoothly transition from the impedance of the cable to the impedance of the connector.

11 Claims, 3 Drawing Sheets

COAXIAL CABLE CONVERTER

BACKGROUND OF THE INVENTION

The present invention relates to coaxial cables and connectors. In particular, the invention relates to a converter or adapter for joining coaxial cables to coaxial connectors, where the connector is not specifically designed to accept the size of the coaxial cable.

All coaxial cable connectors are designed to work with specific cable conductor sizes and types, or specific ranges of cable conductor sizes and types. If a need arises for using a coaxial connector with a coaxial cable which is outside the designed range of the connector, it is typically not possible to accommodate the out-of-range cable. Such needs are becoming increasingly common as the increased performance of larger coaxial cables is desired in high performance applications. Specifically, larger coaxial cables are often desired to reduce signal losses in applications where the signal must be transmitted over an extended distance.

In many situations where use of a larger coaxial cable is desired, system designers often are unable or prefer not to use larger coaxial connectors which are capable of accepting a larger coaxial cable because the interconnect system is already in use in other parts of the system. Instead of being able to use the desired connector and cable combination, a smaller coaxial cable than desired must be used or the connector must be substantially redesigned to accept the desired cable. The use of a smaller than desired coaxial cable or redesigned connector may lead to less than optimal performance of the system in which the connector and cable assembly is used, or, if a certain level of performance is absolutely required, may require completely new connector and/or cable designs to obtain the desired performance. Neither of these options is desirable to the end user, as less than optimal performance may not be acceptable in the intended application, and new connector or cable designs may be exceptionally expensive.

Clearly, it would be highly desirable if an adapter or converter was available to allow the easy and quick combination of coaxial connectors and coaxial cables which where not originally designed for use together, while at the same time maintaining the performance levels of the connector and cable.

SUMMARY OF THE INVENTION

The present invention provides a versatile converter for terminating a coaxial connector to a coaxial cable when the cable shield layer outer diameter is larger than an interior dimension of the connector shell. The converter may be used to match the impedance of either the cable or the connector, or may be used to smoothly transition between the impedance of the cable and the impedance of the connector.

In a preferred embodiment, the converter includes a conductive shell having a first cylindrical section and a second cylindrical section. A transitional section tapers between the first and second cylindrical sections. The first cylindrical section has an inner diameter larger than the outer diameter of the cable conductive shield layer, and the second cylindrical section has an outer diameter smaller than the interior dimension of the connector shell. A dielectric insulation insert is positioned with the transitional section of the converter shell. The dielectric insulation insert may be formed so that the converter impedance matches the impedance of either the coaxial cable or the connector, or it may alternately be formed to smoothly transition from the impedance of the cable to the impedance of the connector.

In use, the cable conductive shield layer is electrically connected to the first cylindrical section of the converter and the second end of the converter is electrically connected to the connector outer shell, thereby establishing electrical continuity between the connector shell and the cable shield. The cable inner conductor passing through the converter and into the connector where it is terminated in the normal manner.

DETAILED DESCRIPTION OF THE INVENTION

Figure 1A:
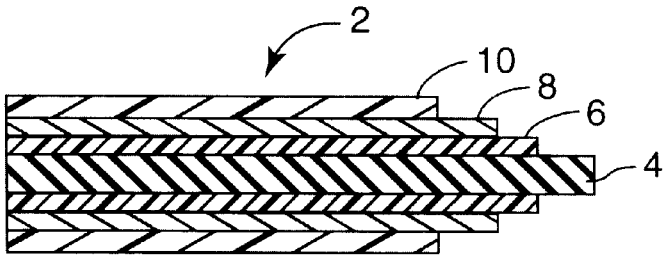
FIG. 1A PRIOR ART
FIG. 1A is a cross-section of a coaxial cable.

Coaxial cable 2 as shown in FIG. 1A has a center conductor 4, surrounded by a dielectric insulation layer 6, a conductive shield layer 8, and an outer insulating layer 10. Such cables are commonly used in high performance applications, and must be terminated to a variety of coaxial cable connectors.

The inventive converter described herein may be used with many types of coaxial cable connectors. Examples include the shielded controlled impedance (SCI) connector and surface mount controlled impedance (SMCI) connector available from Minnesota Mining and Manufacturing Company (3M) of Saint Paul, Minn., USA, and the SSMA Connector HRMM Series available from Hirose Electric Company, Ltd., of Tokyo, Japan.

For ease of description, the invention is described herein with respect to a single type of coaxial connector. Specifically, the inventive converter is described herein with respect to a shielded controlled impedance (SCI) connector, available from 3M (hereinafter "the 3M SCI connector"). Those skilled in the art will readily recognize that the inventive converter may be easily adapted to a variety of other coaxial connector embodiments without departing from the scope and spirit of the invention.

The 3M SCI connector was designed to work with coaxial cables in which the outside diameter of the coaxial shield was about 0.060 inches. The 3M SCI connector is designed to allow the use of a 75 ohm coaxial cable with a foamed polymer insulator and a 30 AWG (American Wire Gauge) stranded or solid center conductor (available from 3M under the product number 041, as well as a number of 50 ohm coaxial cables of several different gauges, such as those available from 3M under the product numbers 017 and 027.

If an end-user specified system design requires using the 3M SCI connector with a coaxial cable having a larger center conductor than those described above (to reduce signal loss and/or maintain impedance, for example), the outside diameter of the coaxial cable shield would be too large to fit within the SCI connector shell without modification. For example, the end-user's system design may specify use of a 75 ohm coaxial cable with a 28 AWG 7 stranded center conductor. This particular coaxial cable would have an outside shield diameter of 0.0725 inches if the primary insulation of the cable has a dielectric constant of 1.44. If the dielectric constant of the primary insulation was higher, the outside diameter of the shield would be even larger (assuming the same size wire is used in the braided shield). To accommodate the larger outside diameters of the coaxial cable shield, part of the plastic insulative body of the SCI connector must be removed from within the outer conductive shell to provide room in the connector for the cable shield.

Figure 1B:
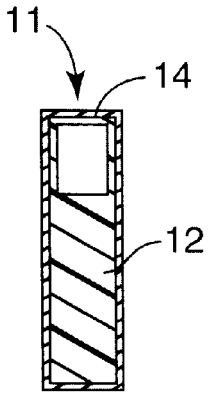
FIG. 1B PRIOR ART
FIG. 1B is an end view of an unmodified coaxial connector.
Figure 1C:
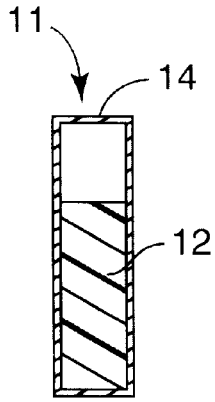
FIG. 1C PRIOR ART
FIG. 1C is an end view of a modified coaxial connector.
Figure 2:
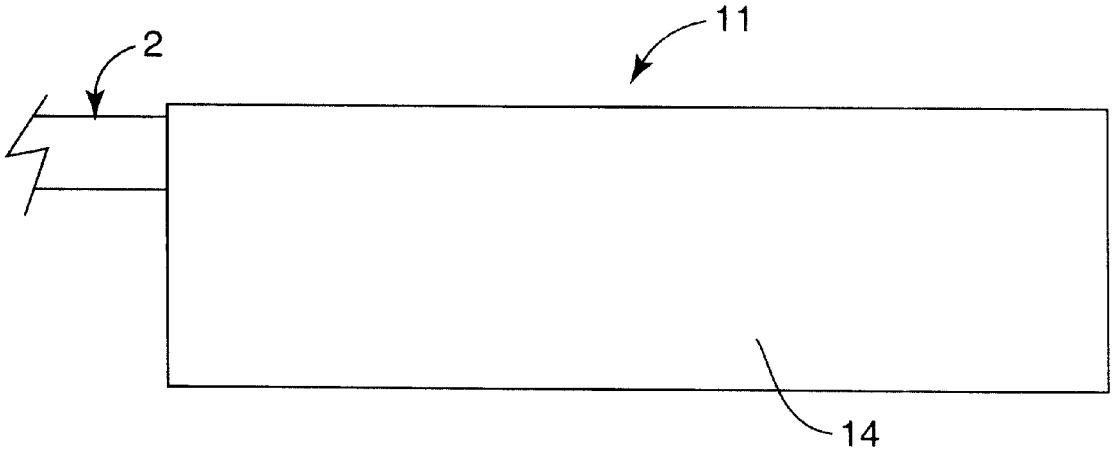
FIG. 2 PRIOR ART
FIG. 2 is a side view of a coaxial connector terminating a coaxial cable.

FIG. 1B illustrates the top end portion of the unaltered 3M SCI connector 11 (without a coaxial cable inserted), while FIG. 1C provides a similar view illustrating the 3M SCI connector 11 after a portion of the plastic insulating body 12 has been removed from within the conductive outer shell 14 to accommodate the larger 28 AWG center conductor 4 and shield 8 of the coaxial cable 2. FIG. 2 illustrates a side view of the 3M SCI connector 11 when a coaxial cable 2 is installed.

As illustrated by FIG. 1C, to a limit, removing a portion of the plastic body 12 of the SCI connector allows a larger coaxial cable 2 to be terminated. However, where even lower losses are required, it is desirable or necessary to use coaxial cables 2 having even larger center conductors 4 and larger outer shield 8 diameters. In such instances, simply removing a portion of the plastic body 12 will be insufficient to accommodate a larger coaxial cable 2.

The present invention allows coaxial cable connectors 11 to terminate coaxial cables 2 which otherwise are physically too big to be accommodated by the connector 11. For example, the present invention makes it possible to terminate a 24 AWG or larger gauge coaxial cable conductor 4 in a connector 11 that was designed for a 30 AWG coaxial cable. In fact, the present invention allows the termination of any size coaxial cable to a connector. The only limiting factors are the physical strength of the materials forming the converter and the connector, and the dimensions of the center conductor 4 of the cable (because the center conductor 4 of the cable 2 must be able to fit within the shell 12 of connector 11).

In most instances, from an electrical performance standpoint, wire gauge of the center conductor 4 is not the limiting factor. That is, in most instances, to achieve the desired electrical performance, it is not necessary to use a cable 2 having a center conductor 4 which is so large that it cannot fit within the outer conductive shell 14 of the connector 11. To attach a larger coaxial cable 2 to a connector, the inventive adapter or converter 20 provides a "funnel" that transitions from a first large end capable of accepting the desired coaxial cable to a second small end capable of being inserted into the body of the connector.

Figure 3:
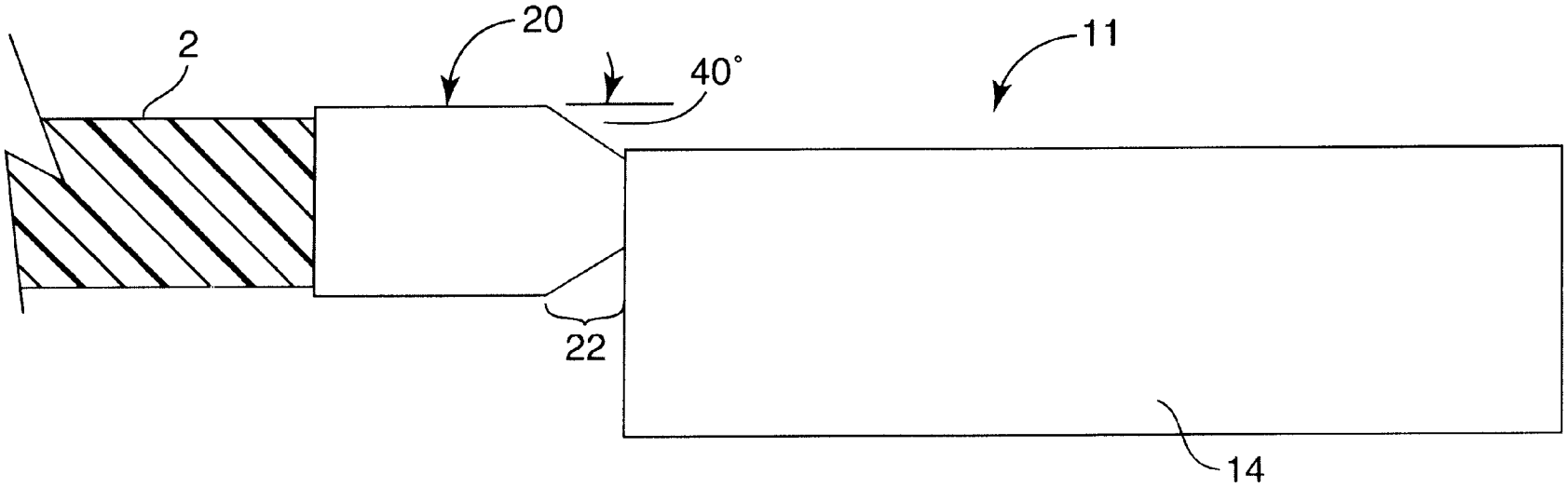
FIG. 3 is a side view of a coaxial connector using the inventive coaxial cable converter to terminate a coaxial cable.

FIG. 3 shows a 3M SCI connector 11 like that in FIG. 2, using the inventive converter 20 described herein to terminate an oversize coaxial cable 2. As can be seen by comparing FIGS. 2 and 3, the diameter of the coaxial cable 2 using the converter 20 in FIG. 3 is more than twice the diameter of the largest possible cable size which can be terminated without the converter 20. Thus, the limitation on the size of the coaxial cable 2 is not the outer diameter of the coaxial shield 8, but rather the outer diameter of the center conductor 4 and how it relates to the impedance of the cable/connector assembly.

In FIG. 3, the transition section 22 of the converter 20 is shown to be at about a forty degree (40°) angle. Although any angle would conceivably work in the transition section 22, there are several factors which lead to a preferred transition angle. First, if the angle is ninety degrees (90°), the impedance transition from the coaxial cable impedance to the connector impedance would be very short. In this instance, a suitable dielectric material, such as a preformed poly tetrafluoroethylene (PTFE) or fluorinated ethylene polypropylene (FEP) tube may be provided in the interior of the converter 20 which would match the impedance of either the coaxial cable 2 or the connector 11. In this case, the signal would see no transition when the coaxial cable 2 and the connector 11 have matching impedances, or only a single transition if the impedances of the connector 11 and the coaxial cable 2 are different. Further, as described below, it is possible to design the converter dielectric so that the transition is smooth (slowly changing) if so desired.

Figure 4:
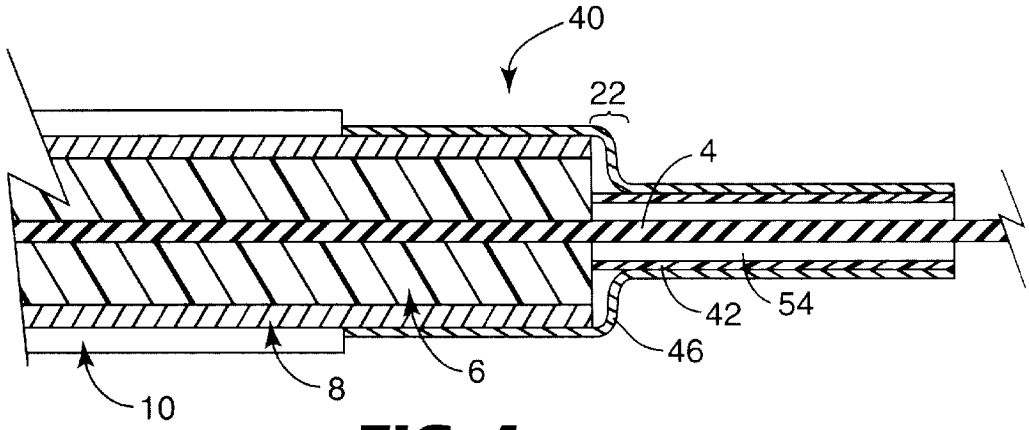
FIG. 4 is a first embodiment of the coaxial cable converter with a coaxial cable.
Figure 5:
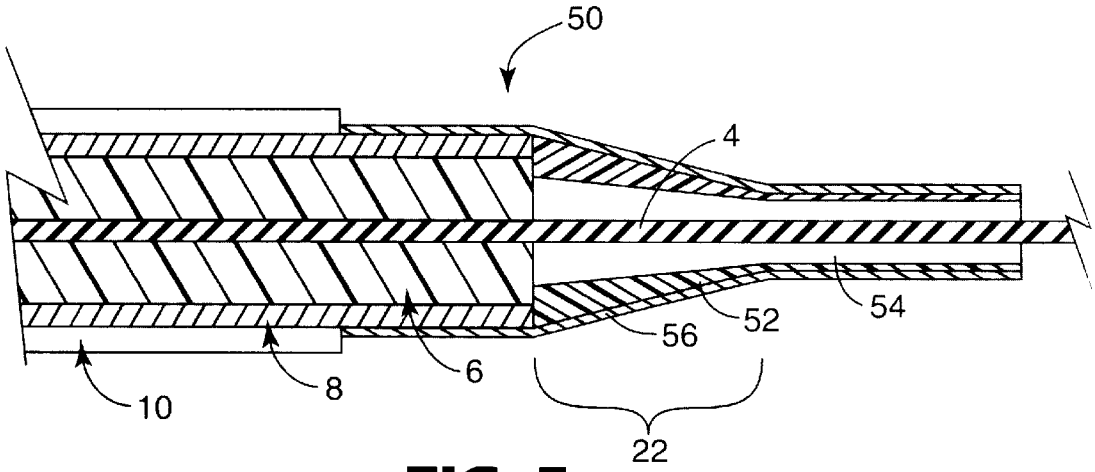
FIG. 5 is a second embodiment of the coaxial cable converter with a coaxial cable.
Figure 6:
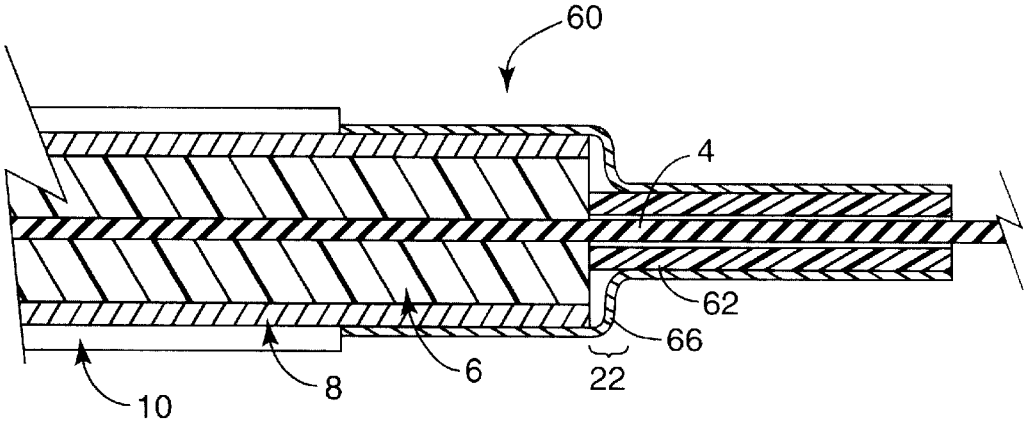
FIG. 6 is a third embodiment of the coaxial cable converter with a coaxial cable.

FIGS. 4–6 illustrate various alternate converter configurations. FIG. 4 shows a converter 40 that can be used if no impedance transition is necessary because the coaxial cable 2 and the connector (not shown in FIG. 4) have the same impedance. In this situation, the converter dielectric insulation 42 is formed so as to match the impedance of the cable 2 and connector. FIG. 5 shows a converter 50 which provides a smooth transition between the different impedances of the cable 2 and the connector (not shown in FIG. 5). FIG. 6 shows a converter 60 that provides a single transition between the different impedances of the cable 2 and the connector (not shown in FIG. 6). In this instance, the converter dielectric insulation 62 is formed so as to match either the impedance of the cable 2 or the impedance of the connector, with no smooth transition between the different impedances.

As can be seen in FIG. 5, the amount of dielectric material 52 in the converter 50 changes as the radius of the converter changes. The rate of change will be selected to match the desired rate of change for the impedance. Although the radius change in FIG. 5 is linear along the length of the converter, a different relationship between the quantity of dielectric insulation 52 and its position within the converter could be used. The effective dielectric constant of the converter may be adjusted by changing the amount of air 54 that is included between the converter dielectric material 52 and the coaxial cable center conductor 4. For example, if the application requires the converter 50 to have the highest possible impedance, the thinnest converter dielectric 52 should be used with the lowest dielectric constant, such as PTFE or FEP tubing. In this way, the maximum amount of air 54 (the lowest dielectric constant material) will surround the coaxial cable center conductor 4, which in turn will maximize impedance in the converter 50. When the impedance of the converter is too high, the quantity of dielectric insulation 52 is simply increased to reduce the air gap between the dielectric insulation 52 and the center conductor 4.

In the most complex form of the converter (corresponding to FIG. 5), the dielectric insulation 52 is formed to match the inside diameter of the transition portion 22 of the converter body 56, and the inside radius of the dielectric insulation 52 selected to provide the desired impedance profile. In the simplest form (corresponding to FIGS. 4 and 6), the converter dielectric 42, 62, respectively, is designed with clearance between the transition portion 22 of the converter wall 46, 66, respectively, and the dielectric's outer diameter, and between the inside diameter of the dielectric and the coaxial cable center conductor 4.

The coaxial cable 2 may have a foamed or air filled dielectric insulation 6, while the converter dielectric 42, 52, 62 will most conveniently be a solid material. The material for the shell 46, 56, 66 of the converter 40, 50, 60 is preferably a metal such as copper, brass or any other metal capable of being formed in the desired shape and which allows easy electrical connection to both the connector and the coaxial cable outer shield 8. In instances where corrosion resistance is a factor, metal alloys such a nickel-silver may be used, or plated copper or brass could also be used.

By using a wall tube 46, 56, 66 of appropriate thickness for the converter, a design can be selected which will provide reasonable impedance matching, easy assembly and low cost. The converter designs of FIGS. 4 and 6 are particularly inexpensive and easy to manufacture.

What is claimed is:

1. A converter for terminating a coaxial connector of the type having an outer conductive shell and an inner insulative housing to a coaxial cable of the type having a center conductor, an inner dielectric layer, a conductive shield layer and an outer insulative layer, wherein the cable shield layer outer diameter is larger than an interior dimension of the connector shell, the converter comprising:

a conductive shell having a first end and a second end, the first end having an inner diameter larger than the outer diameter of the cable conductive shield layer, and the second end having an outer diameter smaller than the interior dimension of the connector shell; and a dielectric insulation insert positioned within the converter shell, wherein the converter shell includes a first cylindrical section adjacent the first end, a second cylindrical section adjacent the second end, and a transitional section between the first and second cylindrical sections, and wherein the dielectric insulation insert extends through the transitional section and the second cylindrical section.

2. A coaxial cable and connector assembly comprising:

a coaxial connector having a conductive outer shell; the outer conductive shell having an inner dimension;

a coaxial cable having an inner conductor, an inner dielectric insulation, a conductive shield layer, and an outer insulative layer, wherein the diameter of the cable inner conductor is smaller than the inner dimension of the connector shell, and wherein the diameter of the cable conductive shield layer is larger than the inner dimension of the connector shell; and a cable converter having a conductive shell extending from a first end and a second end, the first end having an inner diameter larger than the diameter of the cable conductive shield layer, and the second end having an outer diameter smaller than the inner dimension of the connector shell, wherein the cable conductive shield layer is electrically connected to the first end of the converter and wherein the second end of the converter is electrically connected to the connector outer shell, the cable inner conductor passing through the converter into the connector.

3. The assembly of claim 2, further comprising a dielectric insulation insert positioned within the converter between the converter shell and the cable inner conductor.

4. The assembly of claim 3, wherein the impedance of the converter matches the impedance of either the coaxial cable or the connector.

5. The assembly of claim 3, wherein the converter has an impedance that smoothly transitions from the impedance of the cable to the impedance of the connector.

6. The assembly of claim 2, wherein the converter includes a first tubular section adjacent the first end, a second tubular section adjacent the second end, and a transitional section extending between the first and second section.

7. The assembly of claim 6, further comprising a dielectric insulation insert positioned within the transitional section and second section of the converter, the insert positioned between the cable center conductor and the converter shell.

8. The assembly of claim 7, wherein the dielectric insert is formed to match the shape of the transition section of the converter shell.

9. The assembly of claim 7, wherein the dielectric insulation insert is in contact with only the converter shell.

10. The assembly of claim 7, wherein the dielectric insulator insert is in contact with the converter shell and the cable center conductor.

11. The assembly of claim 2, wherein the conductive shield layer is terminated within the first section of the converter.

* * * * *